US007381027B2

(12) United States Patent
Kaneko et al.

(10) Patent No.: US 7,381,027 B2
(45) Date of Patent: Jun. 3, 2008

(54) FAN MOTOR

(75) Inventors: Sachiko Kaneko, Chiba (JP); Yuji Shishido, Kanagawa (JP); Toshio Hashimoto, Tokyo (JP); Tooru Kimura, Tokyo (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 10/847,360

(22) Filed: May 18, 2004

(65) Prior Publication Data

US 2004/0258527 A1 Dec. 23, 2004

(30) Foreign Application Priority Data

May 28, 2003 (JP) ..... P2003-150009

(51) Int. Cl.
*F04D 29/30* (2006.01)

(52) U.S. Cl. ..... 415/206; 415/102; 415/176; 415/177; 416/183; 416/185; 416/228; 416/236 R; 416/237

(58) Field of Classification Search ..... 415/175–178, 415/102, 206, 173.5, 174.5; 416/185, 186 R, 416/228, 235, 236 R, 236 A, 237, 183, 184; 361/695–697
See application file for complete search history.

(56) References Cited

U.S. PATENT DOCUMENTS

| | | | | |
|---|---|---|---|---|
| 4,930,981 | A * | 6/1990 | Walker | 416/228 |
| 5,309,983 | A * | 5/1994 | Bailey | 361/697 |
| 5,979,541 | A * | 11/1999 | Saito | 361/697 |
| 6,579,064 | B2 * | 6/2003 | Hsieh | 416/185 |
| 6,619,385 | B2 * | 9/2003 | Watanabe et al. | 361/697 |
| 6,665,181 | B2 * | 12/2003 | Tanaka et al. | 361/695 |
| 2002/0108211 | A1 * | 8/2002 | Svoboda | 416/235 |
| 2003/0017048 | A1 * | 1/2003 | Lin | 415/206 |
| 2003/0063976 | A1 * | 4/2003 | Horng et al. | 416/183 |

FOREIGN PATENT DOCUMENTS

| | | | | |
|---|---|---|---|---|
| DE | 2546280 | A * | 4/1977 | 416/228 |
| JP | 58-35296 | A * | 3/1983 | 416/183 |
| JP | 59-5896 | A * | 1/1984 | 416/236 A |
| JP | 10-306795 | A * | 11/1998 | |
| JP | 11-141494 | A * | 5/1999 | |
| SU | 706570 | * | 12/1979 | 416/228 |

* cited by examiner

*Primary Examiner*—Christopher Verdier
(74) *Attorney, Agent, or Firm*—Rader Fishman & Grauer PLLC; Ronald P. Kananen

(57) ABSTRACT

A fan motor having a small thickness and its impeller's blades formed to have a longer length in the diametrical direction than a width in the axial direction. Since the blade of the fan motor has a tooth structure or chamfers at its edge end in the diametrical direction, turbulence is forcibly evoked in an airflow to promote the turbulent diffusion, thereby suppressing the trailing vortex and reducing the aerodynamic noises, and thus the ventilation efficiency is improved.

6 Claims, 5 Drawing Sheets

PRIOR ART

FAN MOTOR

CROSS REFERENCE TO RELATED APPLICATION

The present document is based on Japanese Priority Document JP2003-150009, filed in the Japanese Patent Office on May 28, 2003, the entire contents of which are incorporated herein by reference to the extent permitted by law.

BACKGROUND OF THE INVENTION

1. Field of the Invention

The present invention relates to a fan motor having a small thickness and its blades formed to have a tooth structure or chamfers at the edge ends.

2. Description of the Related Art

As notebook PCs and other apparatuses have become increasingly thinner, they are expected to become much thinner in the future. Accordingly, cooling devices that will be used in notebook PCs, such as fan motors, will also be required to be much thinner. However, as notebook PCs become thinner, the temperature inside the housing increases and the ventilation efficiency decreases as the width of blades for dissipation of heat to the outside becomes narrow. As a possible method to earn a negative pressure area for extra space produced from the results of making a blade width thinner, there is a technique of making a length of the blade in a diametrical direction longer.

As a fan motor to be mounted on a notebook PC for heat dissipation, a fan motor having a small thickness is used, which has a multi-blade centrifugal impeller to integrally rotate with a motor's rotor of a motor within a housing.

A multi-blade centrifugal fan such as a sirocco fan has an airflow structure in which an air current is created by a centrifugal force from the center to an outer circumferential direction. To improve the ventilation efficiency, a saw-toothed structure 42 is provided at edge ends of inner and outer peripheries of a blade 41 in an axial direction, as shown in FIG. 13 (for example, refer to Japanese Patent Application Publication No. Hei-11-141494 (FIG. 4, FIG. 5), or a plurality of annular plates are stacked at an outer periphery of an impeller in a predetermined pitch, (for example, refer to Japanese Patent Application Publication No. Hei-10-306795 (FIG. 1 to FIG. 5)) to reduce aerodynamic noises produced by trailing vortex of the rear edge end-side of the blade.

SUMMARY OF THE INVENTION

In the fan motor having a small thickness, however, since it is difficult to have a sufficient impeller width in an axial direction, the number of teeth of the sawtoothed structure to be formed at edge ends of the inner and outer peripheries of the blade or the number of the annular plates to be stacked at the outer periphery of the impeller with a predetermined pitch decreases. Therefore, the effect of the above structures is limited. In addition, to form the sawtooth structure (a structure of a plurality of teeth, or protruding and recessed portions) at the inner and outer peripheries of the blade edge ends in the axial direction, a die for molding an impeller having such blades will have a complicated structure such as a slide-type die (a multi-divided die) and the like. Such die structure strictly requires diameter accuracy and thermal management for die fitting, thus resulting in an increased cost of fabricating the die. In addition, in the method of stacking annular plates, the number of component parts and manufacturing process steps will be increased, thus also resulting in increased product cost.

The present invention has been conceived to address the above-mentioned issues and aims at providing a fan motor having a small thickness that enables the reduction of aerodynamic noises and improves the ventilation efficiency by forming a tooth structure (a structure of a plurality of teeth or protruding and recessed portions) or chamfers at the edge end of its blade in a diametrical direction, the length of the blade in a diametrical direction being made longer than the width in an axial direction. Further, the blade of the fan motor in the present invention may be formed by an easy process.

The present invention provides a fan motor having a small thickness and a multi-blade centrifugal impeller integrally rotating with a rotor of a motor provided in a housing, and a blade of the impeller is formed so as to have a longer length in a diametrical direction than a width in an axial direction, wherein a tooth structure or chamfers are formed at the edge ends of the blades in the diametrical direction.

As described above, the present invention provides the fan motor having a small thickness and its impeller blades formed such that the length in the diametrical direction is longer than the width in the axial direction. Since the blade has the tooth structure or chamfers at its edge end in the diametral direction, which is longer than the width in the axial direction, the trailing vortex is suppressed and the aerodynamic noises are reduced, and the ventilation efficiency is improved as compared to a blade in the related art, which has a tooth structure at the edge end in the axial direction. Therefore it is possible to make a fan motor of similar functionality smaller and thinner.

Further, an impeller of a fan motor is normally fabricated with a resin molding; however, the tooth structure or chamfers are formed at the edge end portion of the blade in the diametrical direction according to the present invention, and a general up and down mold structure can be used to fabricate this impeller. As a result, the impeller may be manufactured inexpensively because the cost of the die can be reduced and extra manufacturing processes are not necessary.

DESCRIPTION OF THE PREFERRED EMBODIMENTS

First Embodiment

Figure 1:
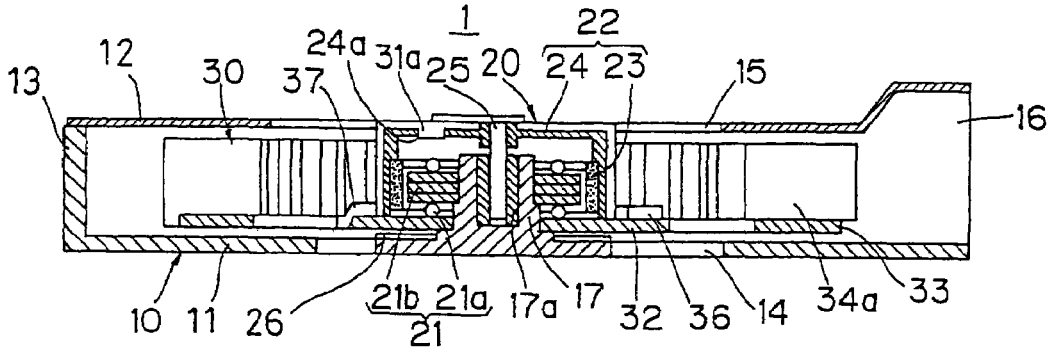
FIG. 1 is a sectional side elevation of a fan motor according to a first embodiment.
Figure 2:
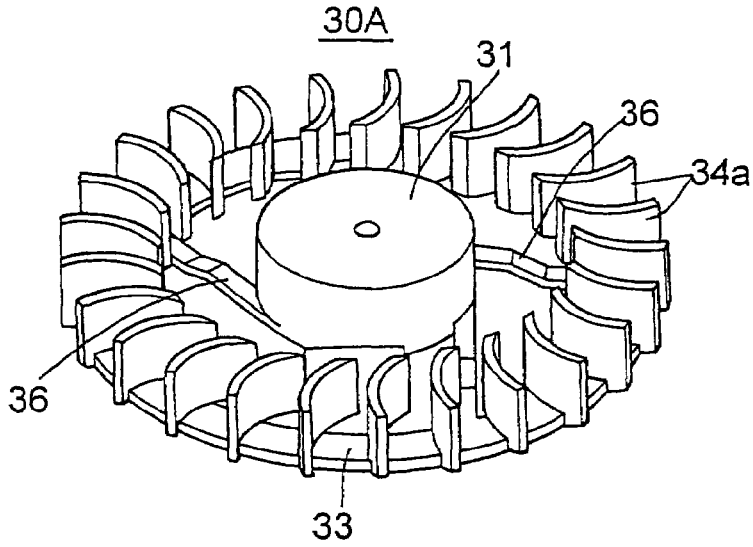
FIG. 2 is a perspective view showing an impeller of a fan motor.
Figure 3:
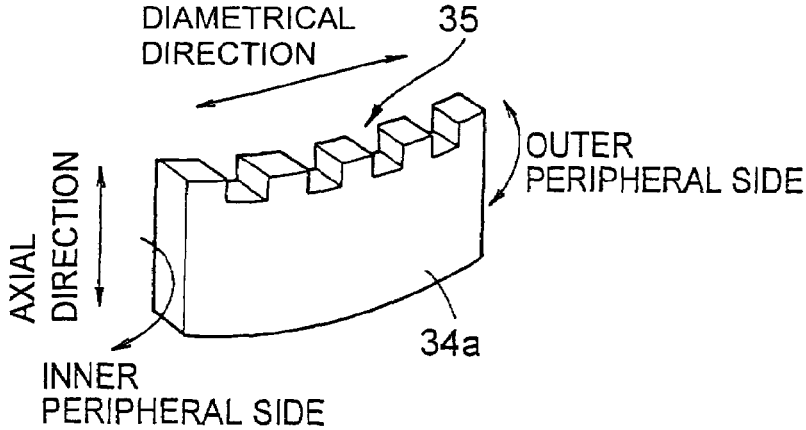
FIG. 3 is a perspective view showing a blade structure of an impeller.

FIG. 1 shows a cross-sectional view of a fan motor according to an embodiment of the present invention; FIG. 2 shows an impeller of a fan motor; and FIG. 3 shows a configuration example of a blade of an impeller. Fan motor 1 is constituted by a flat-shaped housing 10, a motor 20 of an outer rotor type provided within the housing 10, and a resin impeller 30A integrally rotating with the rotor.

The housing 10 has inlets 14 and 15 on a lower wall 11 and an upper wall 12, respectively, which are connected to an inside of a blade 34*a* of the impeller 30A, and a blowport 16 on the one side of a side wall 13. In addition, in the central part of the lower wall 11, a hub section 17 having an aperture 17*a* is formed, which supports a stator 21 of the motor 20 and a rotating shaft 25 of a rotor 22.

The motor 20 is configured by an inner stator 21 constituted of a winding 21*a* and a core 21*b*, an outer rotor 22 constituted of a magnet 23 and a rotor case 24, a rotating shaft 25 provided to the rotor case 24, and a driving circuit board 26 provided to the inner surface of the lower wall 11 of the housing 10.

An impeller 30 (30A) is configured by a hub section 31 formed so as to cover the rotor case 24 of the motor 20, an annular plate section 32 covering the under surface of the rotor 22 of the motor 20, an annular main plate 33 on which a plurality of blades 34 is formed, a plurality of arms (spokes) 36 coupling the hub section 31 with the annular main plate 33, and a joint member 37 coupling the hub section 31 with the annular plate 32.

The rotor case 24 of the motor and the hub section 31 of the impeller have an engaging aperture 24*a* and a protruding portion 31*a* for engaging the aperture 24*a* away from the center of their upper portion, respectively. The impeller 30A is configured so as to integrally rotate with the rotor 22 of the motor by engaging the engaging aperture 24*a* with the protruding portion 31*a*.

As shown in FIG. 3, the blade 34*a* of the impeller 30A is formed to have a longer length in a diametral direction than a width in an axial direction (axial direction 7 mm×diametral direction 9 mm), and four pairs of the tooth structure 35 are formed substantially uniformly at the upper edge end in the longer diametral direction.

When applying an electric current to the winding 21*a* of the stator of the motor 20 through the driving circuit board 26, the rotor 22 integrally rotates with the impeller 30A, and the air entered from the inlets 14 and 15 of the housing 10 is discharged from the blowport of housing 10 by a centrifugal force.

Figure 4:
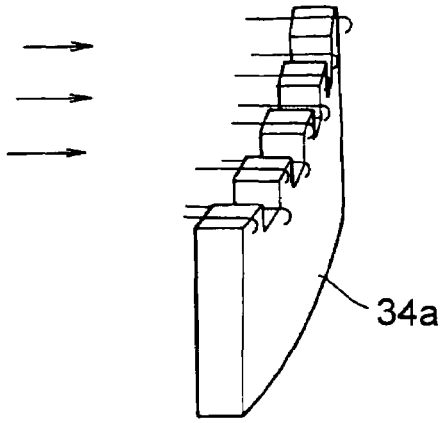
FIG. 4 is an explanatory drawing of airflow in a blade.

Since the tooth structure 35 is provided at the edge end of the blade 34*a* in the diametral direction, in a flow of trailing vortex air generated at the upper end in the diametral direction, turbulence is forcibly evoked by the tooth structure 35 and turbulent diffusion is promoted as shown in FIG. 4. Accordingly, the trailing vortex becomes small, the aerodynamic noise is reduced, and resistance is lowered, thereby improving the ventilation efficiency and reducing its power consumption.

Figure 5:
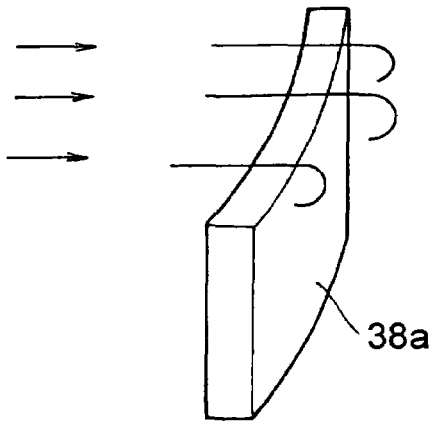
FIG. 5 is an explanatory drawing of airflow in a blade according to a first comparative example.

On the other hand, as shown in FIG. 5, in the case where an impeller having a blade 38*a* formed with its width in a diametrical direction longer than its height in an axial direction and no tooth structure at the edge end is used, the ratio of generating the trailing vortex at the upper and lower edge ends in the longer diametral direction becomes higher than at the shorter, outer-circumferential, trailing-edge end side.

Comparative Example

Figure 6:
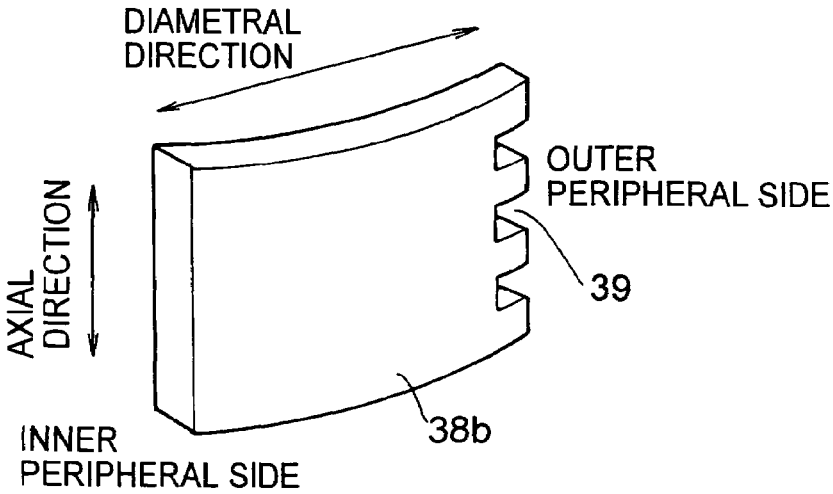
FIG. 6 is a perspective view showing a blade according to a second comparative example.

FIG. 6 shows a blade of an impeller according to a comparative example. The blade 38*b* has three pairs of tooth structure 39 at the edge end in the axial direction of the outer circumferential side. The blade 38*b* is formed of the same size as that of the blade 34*a* having four pairs of the tooth structure 35 at the upper edge end in a diametral direction shown in FIG. 3 (axial direction 7 mm×diametral direction 9 mm).

Figure 7:
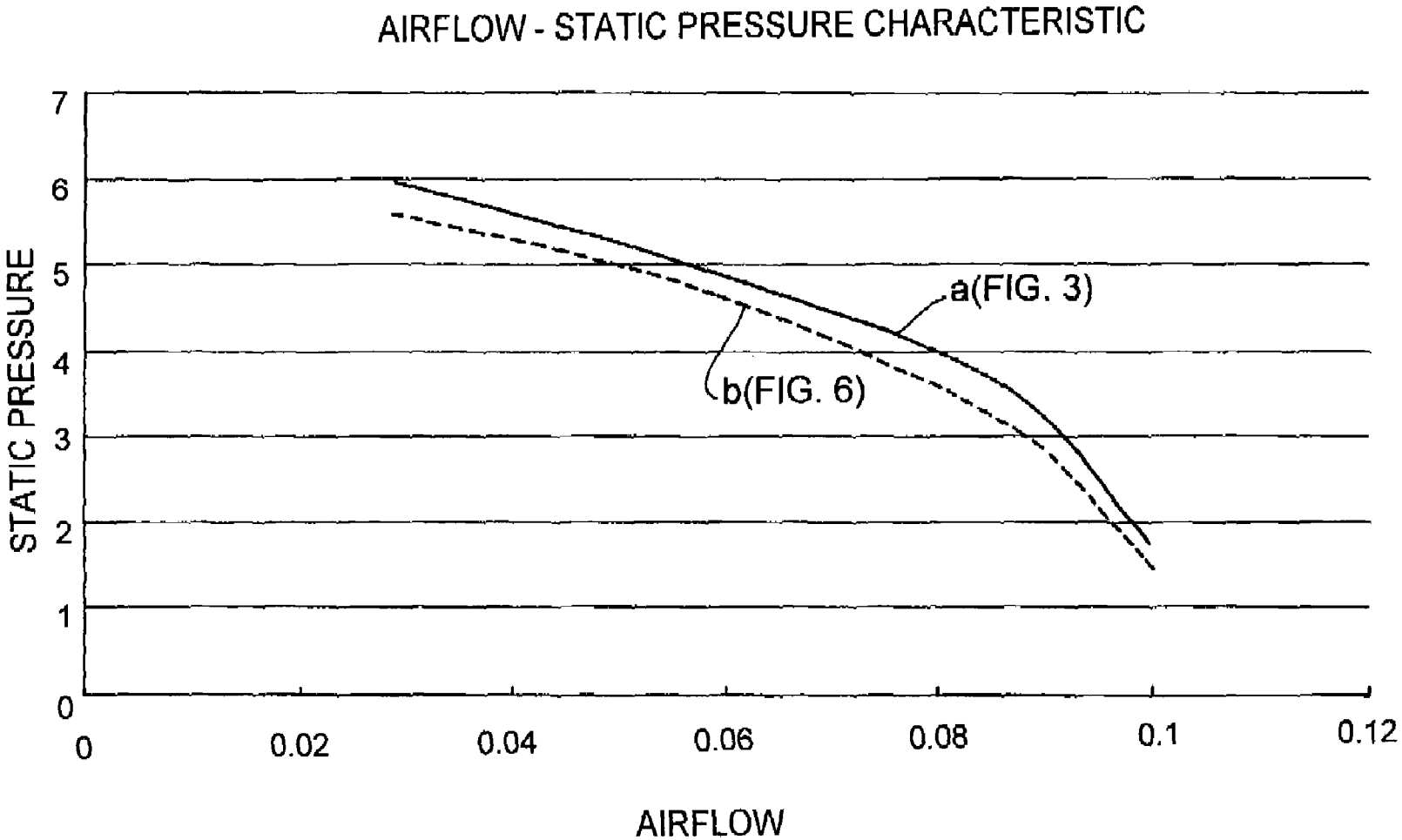
FIG. 7 shows a graph of an airflow-static pressure characteristic of an impeller.

Under the same condition except for the impellers, the static pressures of the impeller 30A having the blade 34*a* on which four pairs of the tooth structure are formed at the upper edge end in the diametrical direction and of the impeller having the blade 38*b* on which three pairs of the tooth structure are formed at the outer circumferential side in axial direction as shown in FIG. 6 were calculated on the terms of the same revolution numbers and airflow. As shown in FIG. 7, an airflow-static pressure characteristic was obtained. In the figure, a curve "a" indicates a characteristic of the impeller having the blade 34*a* (FIG. 3), and a curve "b" indicates a characteristic of the impeller having the blade 38 (FIG. 6). According to the result of this calculation, as for the static pressure, the impeller having the blade 34*a* in FIG. 3 was about 15% higher than the other.

Figure 8:
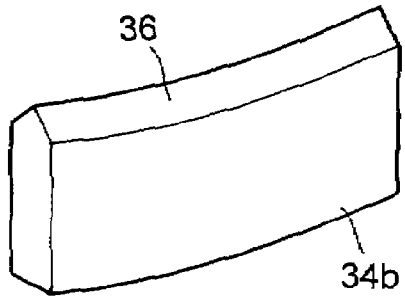
FIG. 8 is a perspective view showing another example of blade structure.

Although the blade 34*a* of the impeller 30A has the tooth structure at the upper edge end in the diametral direction (FIG. 3), the impeller 30A may be changed to the configuration of, as shown in FIG. 8, the blade 34*b* on which chamfers 36 are formed.

If the blade configuration of the impeller 30A is replaced by the blade 34*b* on which the chamfers 36 are formed, in a flow of trailing vortex air generated at the upper end in the diametral direction, similar to the case of the blade 34*a*, the turbulence is forcibly evoked by the chamfers 36 and the turbulent diffusion is promoted. Accordingly, the trailing vortex becomes small, the aerodynamic noise is reduced, and resistance is lowered, thereby improving the ventilation efficiency of the fan motor and reducing its power consumption.

Second Embodiment

Figure 9:
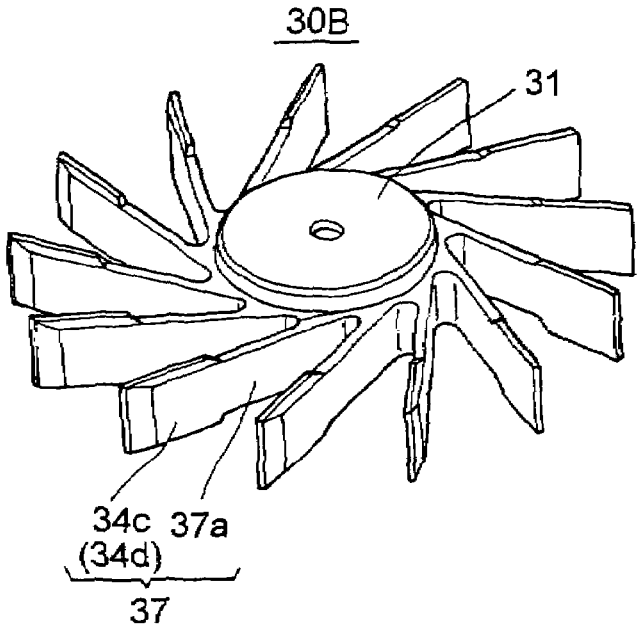
FIG. 9 is a perspective view showing an impeller of a fan motor according to a second embodiment.
Figure 10:
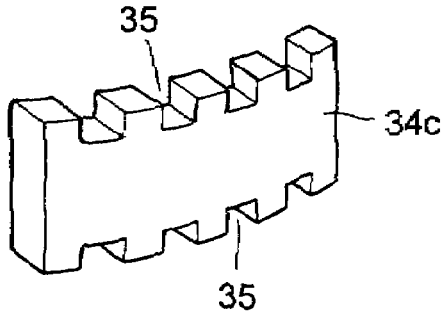
FIG. 10 is a perspective view showing a blade structure of a impeller.

FIG. 9 shows an impeller of a fan motor according to a second embodiment. The impeller 30B is configured by a hub section 31 formed so as to cover a rotor case 24 of a motor 20 (FIG. 1) and a plurality of blade sections 37 integrally formed with the hub section 31. The blade section 37 is constituted by blades 34*c* and an arm part 37*a* supporting the blades 34*c*. A length (width) of the arm part 37*a* in an axial direction is formed shorter than a length of the blade 34*c* in a diametrical direction in order to have enough space between inner surfaces of a lower wall 11 and of an upper wall 12 of a housing 10 (FIG. 1). The blade 34*c* is formed, as shown in FIG. 10, to have four pairs of the tooth structure 35 at its upper and lower edge ends in the diametrical direction.

Since the tooth structures are respectively provided at the upper and lower edge ends of the blade 34*c* in the diametrical direction, the turbulence is forcibly induced in the trailing vortex air flow generated at the upper end and lower edge ends in the diametrical direction and the turbulent diffusion is promoted, and thus the trailing vortex is reduced and aerodynamic noise decreases.

Figure 11:
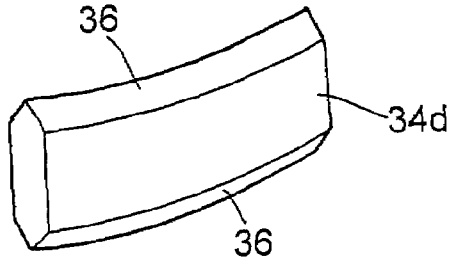
FIG. 11 is a perspective view showing another example of blade structure.

The structure of the blade 34*c* on which the tooth structure is formed may be changed to the structure of the blade 34*d* on which the chamfers are formed at the upper and lower edge ends in the diametrical direction as shown FIG. 11. Even to do so, similar to the case of the blade 34*c*, the turbulence is forcibly induced in the trailing-vortex air flow generated at the upper end and lower edge ends in the diametrical direction and the turbulent diffusion is promoted, and thus the trailing vortex air flow is generated.

Application Example

Figure 12:
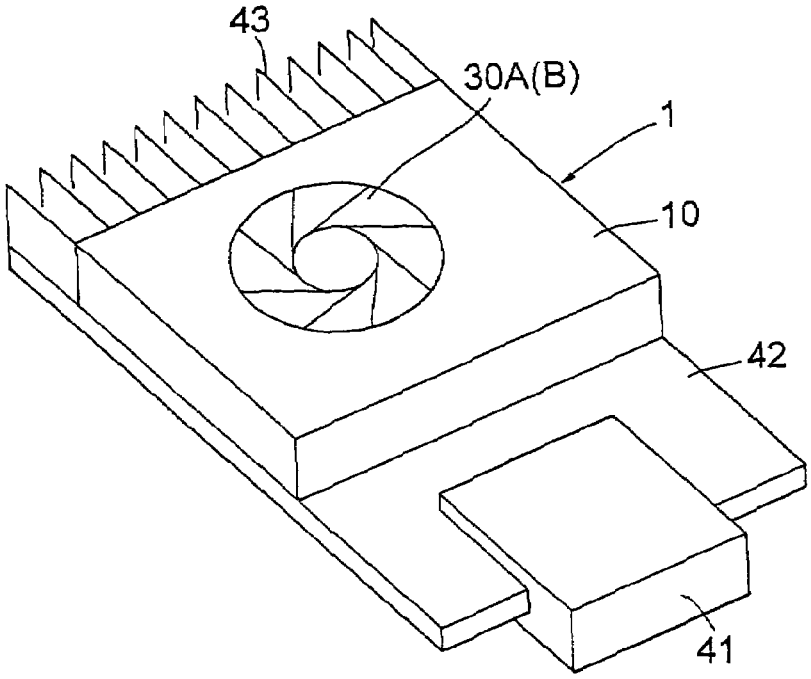
FIG. 12 is a perspective view showing a cooling module according to an application example.
Figure 13:
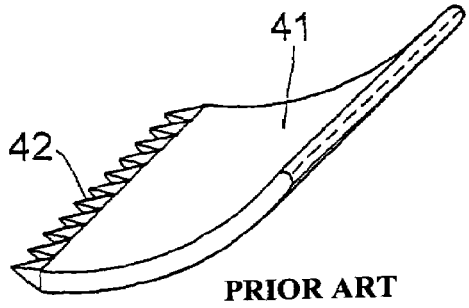
FIG. 13 is a perspective view showing a blade of a fan motor according to the related art.

In FIG. 12, a cooling module utilizing the fan motor according to the present invention is shown. In the figure, reference numeral 41 indicates a heat spreader of a module, which generates the heat largely (for example, a CPU), mounted on a notebook personal computer, reference numeral 42 is a plate-shaped heat pipe provided to the heat spreader, reference numeral 43 is a heat sink constituted by a plurality of heat dissipating fins provided to an upper surface of the heat pipe 42 on the waste-heat side, and reference numeral 1 is the fan motor according to the present invention, which has the impeller whose blade is formed to have the tooth structure or the chamfers at the edge end in the diametrical direction.

A blowport for sending air to the heat sink 43 in the housing 10 of the fan motor 1 is formed widely in order to send air toward a whole rear-end portion of the heat sink 43, and is provided on the heat pipe 42 so as to contact the rear-end portion of the heat sink 43.

According to the application example, the heat dissipation of the heat sink 43 is promoted by the ventilation of the fan motor 1, so that the cooling effect by the heat pipe 42 for the module is improved.

As a die for molding the impeller having the blade 38 with the tooth structure 39 at the edge end in an axial direction shown in FIG. 6, a slide-type metal die (a multi-divided die) is necessary, and this die is a complicated die structure. It causes an increase in the molding process step and affects a manufactured unit's price. On the contrary, the impellers 30A and 30B of the fan motor according to the present invention, because the tooth structure 35 or the chamfer 36 of the blade are formed at the upper or lower edge ends in the diametrical direction, a die for molding the impellers 30A and 30B can be used as a general die, such as a die for molding an impeller whose blade (FIG. 5) has no tooth structure, activate up and down and have a vertically divided structure. It is therefore possible to make the die for fabricating the impellers 30A and 30B with a similar cost as that for making the general die.

Finally, the embodiments and examples described above are only examples of preferred embodiments of the present invention. It should be noted that the present invention is not restricted only to such embodiments and examples, and various modifications, combinations and sub combinations may be made without departing from the scope of the present invention.

What is claimed is:

1. A fan motor comprising a multi-blade centrifugal impeller integrally rotating with a rotor of a motor provided within a housing, a blade of said impeller formed such that a length in a diametrical direction is longer than a width in an axial direction, wherein the axial direction is coincident with a rotational axis of the impeller and the diametrical direction is perpendicular to the axial direction, and wherein a tooth structure having a plurality of protruding and recessed portions is formed on a top edge of said blade, said plurality of protruding portions having a rectangular shape and being arranged in a plane that is parallel to said diametrical direction.

2. A cooling module including said fan motor according to claim 1.

3. The cooling module of claim 2, configured for cooling a personal computer device.

4. A fan motor comprising a multi-blade centrifugal impeller integrally rotating with a rotor of a motor provided within a housing, a blade of said impeller formed such that a length in a diametrical direction is longer than a width in an axial direction, wherein the axial direction is coincident with a rotational axis of the impeller and the diametrical direction is perpendicular to the axial direction, and wherein a tooth structure having a plurality of protruding and recessed portions is formed on a top edge and a bottom edge of said blade, said plurality of protruding portions on said top edge and said bottom edge having a rectangular shape and being respectively arranged in a respective single plane that is parallel to said diametrical direction.

5. A cooling module including said fan motor according to claim 4.

6. The cooling module of claim 5, configured for cooling a personal computer device.

* * * * *